US009047752B2

(12) United States Patent
Bichara

(10) Patent No.: US 9,047,752 B2
(45) Date of Patent: Jun. 2, 2015

(54) ALARM DEVICE TO PREVENT DROWSINESS IN DRIVERS

(71) Applicant: Eduardo Pedro Bichara, Buenos Aires (AR)

(72) Inventor: Eduardo Pedro Bichara, Buenos Aires (AR)

( * ) Notice: Subject to any disclaimer, the term of this patent is extended or adjusted under 35 U.S.C. 154(b) by 71 days.

(21) Appl. No.: 14/029,805

(22) Filed: Sep. 18, 2013

(65) Prior Publication Data

US 2014/0077957 A1 Mar. 20, 2014

(30) Foreign Application Priority Data

Sep. 19, 2012 (AR) ..... 20120103454
Oct. 16, 2012 (AR) ..... 20120103854

(51) Int. Cl.
*G08B 23/00* (2006.01)
*G08B 21/06* (2006.01)

(52) U.S. Cl.
CPC ..... *G08B 21/06* (2013.01)

(58) Field of Classification Search
CPC ..... G08B 21/06
USPC ..... 340/575, 576, 573.1; 180/271, 272
See application file for complete search history.

(56) References Cited

U.S. PATENT DOCUMENTS

| | | | | |
|---|---|---|---|---|
| 6,218,947 | B1 * | 4/2001 | Sutherland | 340/576 |
| 7,710,279 | B1 * | 5/2010 | Fields | 340/575 |
| 8,576,080 | B1 * | 11/2013 | Dobbs | 340/575 |
| 2008/0042856 | A1 * | 2/2008 | Power | 340/575 |

* cited by examiner

*Primary Examiner* — Toan N Pham
(74) *Attorney, Agent, or Firm* — Strategy IP, a professional law corporation

(57) ABSTRACT

The invention relates in general to an alarm device with the shape of a ring, comprising a housing located on its upper end, which contains an alarm system, which is activated upon the first signs of drowsiness or sleep of a human body. The relaxation or loosening of the muscles of the hand causes the pressure exerted on a lever located adjacent the ring to cease, which results in the enlargement of the circumference of the ring so that it will exert pressure on a knob, which in its turn will actuate a horn capable of producing a shrill sound and a vibrator, upon which the driver will recover a state of consciousness.

11 Claims, 5 Drawing Sheets

ALARM DEVICE TO PREVENT DROWSINESS IN DRIVERS

FIELD OF THE INVENTION

This invention relates in general to an alarm device which is activated with the first indications of the human body entering into a state of rest, commonly called sleep.

The alarm device is activated by the relaxation or loosening of body muscles (especially of the hands) caused by drowsiness, fatigue, unconsciousness or other uniform states of rest of the human body.

More particularly, the invention relates to an alarm device that is placed on one or more fingers, the alarm device being activated by the lack of pressure by the fingers or by the grip of the hand grip on a given area of the device. Drowsiness, fatigue or sleepiness of the human body and especially of the fingers cause the finger adjacent to the section of the alarm device shown in FIG. 1, to release pressure on such section of the device, so that because of said lack of pressure the device will produce a shrill sound and a vibration that help the person carrying the device to keep and/or regain wakefulness, and to recover all his senses and reactions.

BACKGROUND OF THE INVENTION

Several studies show that drivers falling asleep while driving is one of the major, most common and dangerous causes of traffic accidents. It is a known fact that the loss of control of a vehicle by its driver, even during just a few seconds, is sufficient to cause a fatal accident to one or more persons.

For drivers who have not had enough sleep, or for drowsy individuals, it is difficult, if not impossible, to prevent their body from going into a state of sleep while they are driving.

Traffic accidents caused by motor vehicles are one of the leading causes of death in modern society. Both in Europe and the United States traffic accidents account for one of the highest morbidity and mortality rates. Motor vehicle accidents are a common complaint from both professional and private drivers, which result in high legal and economic costs to society. Study conducted by the Universidad Nacional de Colombia entitled: Trastorno del sueño, available at: http://www.virtual.unal.edu.co/cursos/medicina/2007860/lecciones/cap5/05_06. htm)".

The identification of physiological factors and individual responsibility as regards driver's behavior are key factors in improving road traffic safety. Recent research suggest that drowsiness and individual perception of driving risks are related factors, and they must be taken into account when developing plans to improve motor vehicle traffic safety. Study conducted by the Universidad Nacional de Colombia entitled: Trastorno del sueño, available at: http://www.virtual.unal.edu.co/cursos/medicina/2007860/lecciones/cap5/05_06. htm)".

Results obtained in terms of a reduction in road traffic accident rates vary depending of the countries studied. In Europe, England and Sweden have the lowest traffic accident rates: 148 and 151 deaths per month per million vehicles respectively, while France has almost twice that figure: 306 deaths per month, per million circulating vehicles. Differences among countries, in terms of attitudes and behavior associated to strategies and individual perception of the risk of driving, are a good explanation for such high accident rates. Study conducted by the Universidad Nacional de Colombia entitled: Trastorno del sueño, available at: http://www.virtual.unal.edu.co/cursos/medicina/2007860/lecciones/cap5/05_06. htm)".

Drowsiness while driving has been identified as a major cause of traffic accidents, especially in vehicle crashes on major highways. However, the significance given to drowsiness and how it contributes to accidents is poorly understood to date. For example, it is a known fact that many traffic accidents are caused by drivers who fall asleep while driving or because they make mistakes associated to drowsiness, which affects their alertness or their judgment while driving. Study conducted by the Universidad Nacional de Colombia entitled: Trastorno del sueño, available at: http://www.virtual.unal.edu.co/cursos/medicina/2007860/lecciones/cap5/05_06. htm)".

Currently available medical evidence suggests that drivers who fall asleep while driving are much more likely to suffer episodes leading precisely to errors of judgment and alertness. For example, a recent study monitoring 40 commercial trailer truck drivers by means of continuous electroencephalograms and face video filming during four to five consecutive days, found that sleep-related behavior patterns such as blinking, the tendency to close the eyes and nodding were significant and actually more frequent than falling asleep episodes as determined by electroencephalographic criteria. Study conducted by the Universidad Nacional de Colombia entitled: Trastorno del sueño, available at: http://www.virtual.unal.edu.co/cursos/medicina/2007860/lecciones/cap5/05_06. htm)".

It is obvious that someone who is electroencephalographically asleep is not able to drive a motor vehicle properly. However, it has been determined that serious problems may develop during the time interval existing between a full state of alertness and the beginning of an electroencephalographically defined sleep episode. For example, attention tests conducted by running surveillance tasks using computers showed that drowsy individuals can successfully perform such tasks for long periods of time with only 1 or 2 episodes of complete isolation or lack of response. However, should such episodes of psychomotor performance failure occur precisely in dangerous situations (e.g., while driving on a highway bend or when approaching another car), they may contribute to or cause serious accidents. Study conducted by the Universidad Nacional de Colombia entitled: Trastorno del sueño, available at: http://www.virtual.unal.edu.co/cursos/medicina/2007860/lecciones/cap5/05_06. htm)".

Drowsiness affects drivers basically in the following ways: a) at the nervous system level, after 16 hours of wakefulness the brain will secrete endorphins disconnecting some parts of the central nervous system; b) at the vision system level, a drowsy person will suffer from blurred vision, inaccurate or wrong distance perception, and c) at the level of reflexes of the central nervous system, signals from sensory neurotransmitters will cause muscle relaxation of neck, arms, hands, legs, and torso, resulting in the immediate loss of control of the vehicle while driving. The literature mentions so-called sleep micro-events, which are very short sleep periods ranging between 1 to 4 seconds. Studies show that a driver operating a vehicle at a speed of 88 km/h and falling asleep during 4 seconds will travel a 30-meter distance having no record whatsoever of such activity (El sueño al volante, Jeovany Ibañez, http://www.mundoymotor.com/mm126/10832811669.htm).

Statistics show that, only in the US, over 100,000 people suffered traffic accidents in 1999 caused by drivers who had fallen asleep. Experts say that drivers' drowsiness is the second leading cause of accidents after alcohol. However, experts also emphasize that accidents caused by drivers who have fallen asleep are 4 times as lethal as accidents caused by drivers driving under the influence of alcohol, as drunk drivers usually tend to stop or slow down their vehicles to avoid accidents, while drivers under the influence of sleep do not record any activity while they fall asleep. (El sueño al volante, Jeovany Ibañez, http://www.mundoymotor.com/mm126/10832811669.htm). Finally, it is recognized that the above mentioned figures about accidents caused by people under the influence of sleep could be even higher, since such cause of accidents is not commonly reported in studies. That is, drivers tend to say they do not remember why the accident happened.

The prior art includes several inventions and/or devices which have been developed to prevent people and/or drivers to fall asleep when they are performing tasks, duties or functions that require to be in a state of consciousness.

Some devices consist of a) a system for monitoring the drivers eyes (U.S. Pat. Nos. 5,786,765; 5,745,038; 4,875,030, etc); b) systems for monitoring the inclination of the head (U.S. Pat. Nos. 5,684,461; 3,906,478; 5,923,263, etc); and c) systems for monitoring other human body parts, such as gloves that grasp to the wheel (U.S. Pat. No. 5,585,785); while other systems consist of a combination thereof (U.S. Pat. No. 6,147,612).

However, none of these inventions and devices have been marketed successfully on a large scale, since they fail to solve a large number of problems. On one hand, devices which have made a greater impact and which are on the market in larger quantities are those monitoring the inclination of the driver's head. However, these devices do not solve the problem of traffic accidents. This is because, usually, the alarm system for which they are designed will only activate when the head of a drowsy driver should incline in certain degree range, such as e.g. greater than 10% degrees, as in U.S. Pat. No. 5,684,462, or about 40% degrees, as in U.S. Pat. No. 3,906,478. However, a time of 1 to 4 seconds is required for the head of a driver to lean to such degree, which is long enough for the driver to lose steering and vehicle control and therefore cause an accident. Devices which monitor eye blinking often trigger false alarms derived from normal eye blinking. In addition, in certain circumstances, the time delay of an alarm activated by eye blinking is of 2 to 3 seconds, which, again, is crucial at the time of avoiding accidents. Devices such as glasses or the like, which are placed on the drivers head, are often not very aesthetic, excessively uncomfortable, and complex since they must be linked to an alarm device connected to the vehicle engine. They are also of little use for people wearing glasses, goggles or for those who, for any reason, cannot use or are uncomfortable using such glasses or fixed devices on their heads. In addition, the cost of such devices is high, considering their limited efficacy.

In view of the above, the aim of this invention is to provide an alarm device to drivers which solves the problem posed by a drowsy driver in a simple, effective, and aesthetic manner. Still another aim of this invention is to provide an alarm device which is user-friendly, simple to manufacture and comparatively cost-effective.

SUMMARY OF THE INVENTION

The alarm device designed according to this invention comprises a ring which is placed on any of the fingers of a person or vehicle driver. The device has the shape of a ring having in its upper portion a housing containing an electric circuit powered by a battery, which enables a buzzer or horn and a vibrator when activated by the pressure exerted by a knob or button. The buzzer or horn and the vibrator are actually activated by the lack of pressure exerted by a knob or button which is located on the outer wall of the housing. In addition, a small lever next to the ring is firmly attached to the lower end thereof. The upper end of the lever is attached to a knob or button located in the housing. In another embodiment the ring may be attached in the manner mentioned above by two levers on either side of the ring. In still another embodiment the housing may contain two activation knobs interchangeably and independently operated by two levers attached by their lower end to the ring and by their upper end to the housing. The ring has an opening on its lower end which makes it flexible enough so the finger of the hand next to the ring lever can exert pressure thereon.

In a preferred embodiment of the invention, the housing of the ring is made of rugged plastic material and can be easily opened to manipulate the electric circuit and replace the battery.

BRIEF DESCRIPTION OF THE FIGURES

The novel features of this invention, as well as the invention itself, both as to its structure and operation, will be best understood with the accompanying figures together with the attached description in which similar reference numbers refer to similar parts and in which.

DESCRIPTION OF PREFERRED EMBODIMENTS

Figure 1:
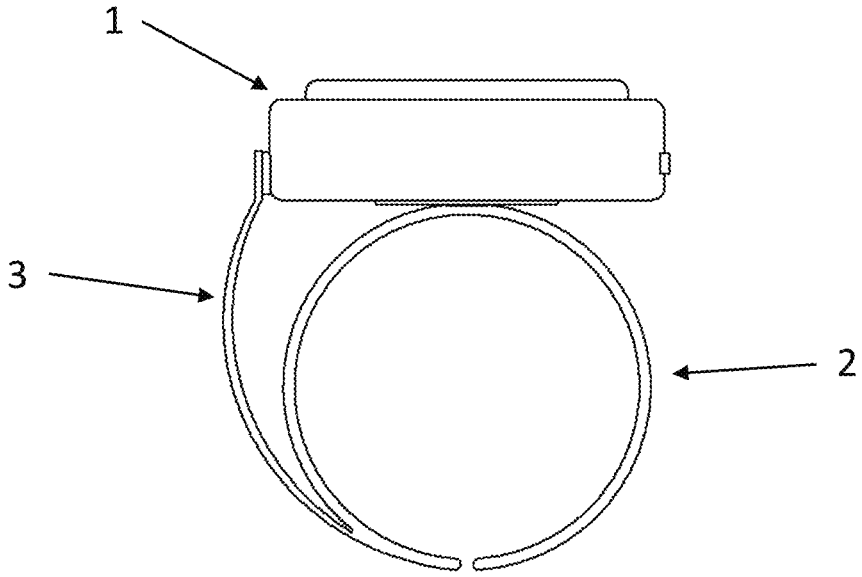
FIG. 1 is a front view of one embodiment of a device according to the invention.
Figure 3:
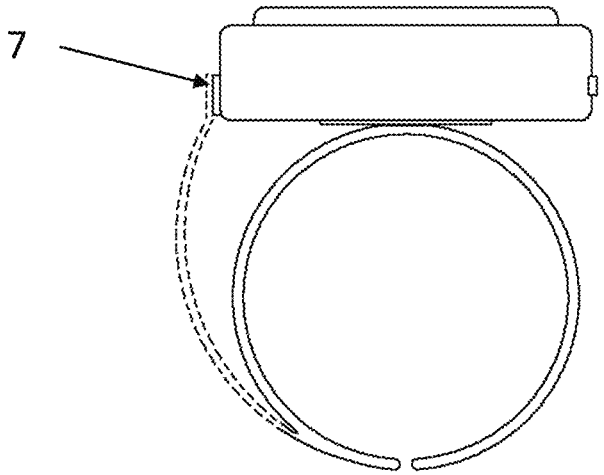
FIG. 3 is a front view of the embodiment of FIGS. 1 and 2 where the lever adjacent to the ring is represented with a dotted line.
Figure 4:
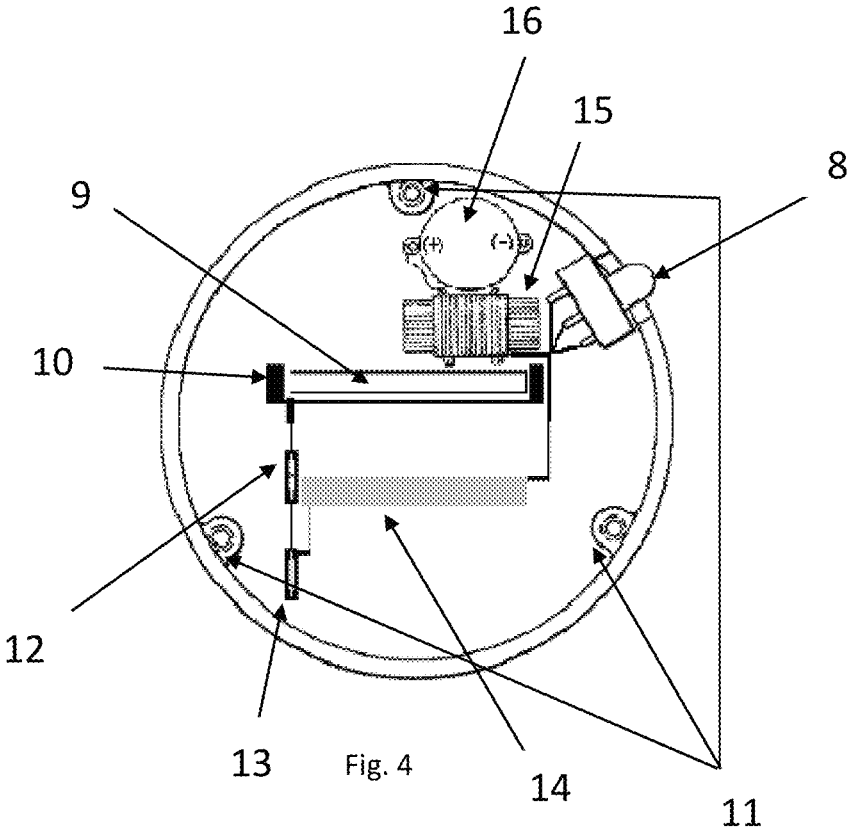
FIG. 4 is a cross sectional view of the housing located on the ring in the embodiment of FIGS. 1-3.
Figure 5:
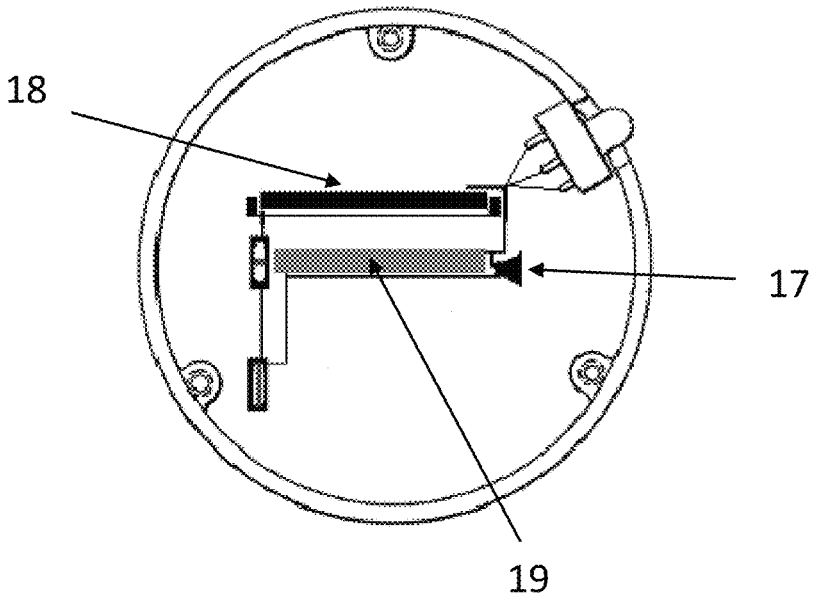
FIG. 5 is a cross sectional view of another embodiment of a device according to the invention.

FIG. 1 shows a schematic presentation of the device which comprises a housing 1 containing an alarm system therein, which is depicted in FIG. 4. FIG. 1 also shows a ring 2 with a lever 3 adjacent thereto. When a driver fits the ring on one of his fingers and closes his hand to grab the steering wheel of the vehicle, the lever 3 shown in FIG. 1 will cease exerting pressure on the knob or button 7 represented in FIG. 3. Such lack of pressure exerted by the closing of the grip causes the knob or button not to contact the batteries 14 and 16 in FIG. 4, therefore it will not actuate the buzzer 15 and the vibrator 9 both shown in FIG. 4. When a driver enters into a sleep micro-event or is in a drowsiness state, his limbs (including the fingers) will start loosening, thus ceasing to exert pressure by his grip and fingers, which in turn will cause the enlargement of the ring circumference, which upper end will then exert pressure on the knob or button, such pressure will therefore activate the electrical circuit, which will in turn actuate the buzzer or horn and the vibrator. That is, when the finger exerting pressure on lever 3 shown in FIG. 1, relaxes, deactivates or loosens, the upper end of the lever will exert pressure on the knob 7 shown in FIG. 3, then such pressure will actuate the buzzer or horn and the vibrator. In a preferred embodiment represented in FIG. 5, the alarm device can be operated by a single battery 19 that will provide power to the buzzer or horn 17 and to the vibrator 18.

The housing 1 of FIG. 1 can be opened by removing the screws 11 of FIG. 4. The knob that activates the electric circuit 8 in FIG. 4 is identified by numeral 8 and the lithium battery pack is identified by numeral 10 of FIG. 4. Numeral 12 represents the open switch of the electric circuit. Numeral 13 represents the close switch of the electric circuit both shown in FIG. 4.

Figure 2:
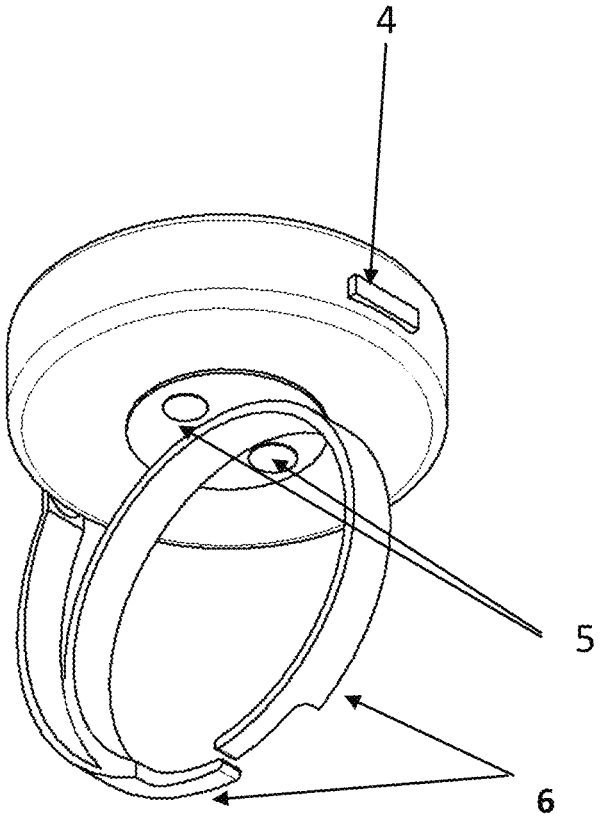
FIG. 2 is lower end view of the embodiment of FIG. 1.

As seen in 6, FIG. 2, the ring is split in its lower end. The opening in the ring provides flexibility to the device so that the ring and the lever next to it can work together as an indivisible whole. The housing 1 shown in FIG. 1, is located and fixed onto the ring by means of small screws or studs 5 as shown in FIG. 2. To preserve the life of the batteries 14 and 16 shown or in FIG. 4 or the single battery 19 shown in FIG. 5, the device comprises an ON-OFF knob 4 shown in FIG. 2.

In addition, the device can be configured so as to operate only by activating either the buzzer or horn, or the vibrator separately. The activation or deactivation is produce by simple ways known in the prior art such us: the lacking of a battery to activation the electric circuit or the by deactivating or closing the electric circuit that feeds the buzzer or horn, or the vibrator.

The invention claimed is:

1. An alarm device characterized by comprising: an apparatus including a ring with a lever adjacent thereto, such lever being attached by its lower end to the ring and by its upper end to a housing containing the alarm device, such device being activated when the lever adjacent to the ring exerts pressure on a knob that is located on a side of the housing thus causing activation of an electric circuit which in turn triggers a horn and a vibrator.

2. A device according to claim 1, characterized in that the ring is made of a light and flexible material.

3. A device according to claim 2, characterized in that the ring may comprise two rings, capable of respectively fitted on two fingers of one hand.

4. A device according to claim 2, characterized in that the ring may comprise three rings, capable of respectively fitted on three fingers of one hand.

5. A device according to claim 2, characterized in that the ring may comprise four rings, capable of respectively fitted on four fingers of one hand.

6. A device according to claim 2, characterized in that the ring comprises two levers respectively attached to either side of the ring.

7. A device according to claim 1, characterized in that the housing comprises an electric circuit using the knob as actuator, at least one power battery, a horn able to produce a shrill sound and the vibrator.

8. A device according to claim 7 characterized in that the housing comprises an electric circuit using two knobs as the actuator.

9. A device according to claim 1, characterized in that the housing comprises the electric circuit using the knob as actuator, two batteries, a horn able to produce a shrill sound and the vibrator.

10. An alarm device characterized by comprising: an apparatus including a ring with a lever adjacent thereto, such lever being attached by its lower end to the ring and by its upper end to a housing containing an alarm device, such device being activated when the lever adjacent to the ring exerts pressure on a knob that is located on a side of the housing thus causing activation of an electric circuit which in turn triggers a horn.

11. An alarm device characterized by comprising: an apparatus including a ring with a lever adjacent thereto, such lever being attached by its lower end to the ring and by its upper end to a housing containing an alarm device, such device being activated when the lever adjacent to the ring exerts pressure on a knob that is located on a side of the housing, thus causing activation of an electric circuit which in turn triggers vibration of the device.

* * * * *